US009758279B2

(12) United States Patent
Stoeppelmann et al.

(10) Patent No.: US 9,758,279 B2
(45) Date of Patent: Sep. 12, 2017

(54) SIDE-GUSSET BAG MADE OF A PLASTIC FABRIC COMPOSITE, AND METHOD FOR THE PRODUCTION THEREOF

(71) Applicant: MONDI HALLE GMBH, Halle (DE)

(72) Inventors: Detlef Stoeppelmann, Steinfeld (DE); Jochen Brauer, Lohne (DE); Jens Koesters, Wallenhorst (DE)

(73) Assignee: MONDI HALLE GMBH, Halle (DE)

( * ) Notice: Subject to any disclaimer, the term of this patent is extended or adjusted under 35 U.S.C. 154(b) by 0 days.

(21) Appl. No.: 14/378,459

(22) PCT Filed: Feb. 13, 2013

(86) PCT No.: PCT/EP2013/052899
§ 371 (c)(1),
(2) Date: Aug. 13, 2014

(87) PCT Pub. No.: WO2013/131727
PCT Pub. Date: Sep. 12, 2013

(65) Prior Publication Data

US 2015/0030265 A1 Jan. 29, 2015

(30) Foreign Application Priority Data

Mar. 7, 2012 (DE) ..... 10 2012 101 932

(51) Int. Cl.
*B65D 30/08* (2006.01)
*B31B 37/00* (2006.01)
(Continued)

(52) U.S. Cl.
CPC ..... *B65D 29/02* (2013.01); *B31B 1/14* (2013.01); *B31B 1/26* (2013.01); *B31B 1/64* (2013.01);
(Continued)

(58) Field of Classification Search
CPC ..... B65D 31/10; B65D 31/02; B65D 29/02; B65D 33/18; B31B 19/14; B31B 19/36;
(Continued)

(56) References Cited

U.S. PATENT DOCUMENTS 146,271 A * 1/1874 Packer ..... B65D 31/02 383/105
221,144 A * 11/1879 Appel ..... B65D 31/10 383/120
(Continued)

FOREIGN PATENT DOCUMENTS

BE 511327 B 5/1952
DE 8432574 U 2/1985
(Continued)

*Primary Examiner* — Peter Helvey
(74) *Attorney, Agent, or Firm* — Andrew Wilford

(57) ABSTRACT

The invention relates to a flat-lying side-gusset bag made of a plastic fabric composite (2) and to a method for the production thereof. The side-gusset bag has opposing front walls (3*a*, 3*b*), side gussets (4*a*, 4*b*) introduced in between said front walls (3*a*, 3*b*), and folding edges (5) between the front walls (3*a*, 3*b*) and the side gussets (4*a*, 4*b*). Peripheral sections of the plastic fabric composite (2) are connected together in an overlapping region (10) at a longitudinal seam, wherein the plastic fabric composite (2) has a plastic fabric (7) and at least one closed plastic layer. The side gussets (5) extend, in the case of the flat-lying side-gusset bag, in each case over at most ⅓ of the width of the front walls. According to the invention, the overlapping region (10) is arranged off-center on one of the front walls (3*a*, 3*b*) at least partially over one of the side gussets (4*a*, 4*b*) or at one of the side gussets (4*a*, 4*b*). In order to be able to form such a side-gusset bag, in the production method, first of all a closed, two-layer tube (12) is formed, from which a side-gusset tube (1) is subsequently formed.

15 Claims, 5 Drawing Sheets

(51) Int. Cl.

| | |
|---|---|
| ***B65D 30/20*** | (2006.01) |
| ***B31B 1/14*** | (2006.01) |
| ***B31B 1/26*** | (2006.01) |
| ***B31B 1/64*** | (2006.01) |
| ***B31B 1/88*** | (2006.01) |
| ***B65D 33/18*** | (2006.01) |

(52) U.S. Cl.
CPC ..... *B31B 1/88* (2013.01); *B31B 37/00* (2013.01); *B65D 31/02* (2013.01); *B65D 31/10* (2013.01); *B65D 33/18* (2013.01); *B31B 2219/269* (2013.01); *B31B 2237/05* (2013.01); *B31B 2237/10* (2013.01); *B31B 2237/403* (2013.01)

(58) Field of Classification Search
CPC .. B31B 19/82; B31B 1/14; B31B 1/26; B31B 1/64; B31B 1/88; B31B 37/00
USPC ..... 383/109, 120; 493/187, 194, 213, 243
See application file for complete search history.

(56) References Cited

U.S. PATENT DOCUMENTS

| | | | | |
|---|---|---|---|---|
| 5,165,799 | A * | 11/1992 | Wood | B29C 65/1483 383/104 |
| 5,195,829 | A * | 3/1993 | Watkins | B65D 81/3469 383/100 |
| 6,572,267 | B1 * | 6/2003 | Forman | B29C 66/4312 383/109 |
| 6,800,051 | B2 | 10/2004 | Koehn | |
| 7,837,388 | B1 * | 11/2010 | Hefner | B65B 9/2028 383/107 |
| 8,297,841 | B2 * | 10/2012 | Bosman | B32B 1/08 229/87.05 |
| 8,827,557 | B2 * | 9/2014 | Wallander | 383/120 |
| 2004/0101215 | A1 * | 5/2004 | Sellmeier | B65D 31/10 383/113 |
| 2005/0041891 | A1 * | 2/2005 | Ausnit | B31B 19/36 383/63 |
| 2006/0228058 | A1 * | 10/2006 | Watterott | B31B 19/82 383/106 |
| 2006/0269173 | A1 | 11/2006 | Koehn | |
| 2007/0036471 | A1 * | 2/2007 | Anasis | B65D 33/14 383/10 |
| 2010/0266223 | A1 * | 10/2010 | Lin | B65D 31/02 383/78 |
| 2010/0290722 | A1 * | 11/2010 | Desmedt | B31B 19/14 383/120 |
| 2013/0121623 | A1 * | 5/2013 | Lyzenga | B65B 9/207 383/203 |
| 2013/0330028 | A1 * | 12/2013 | Bannister | B65D 31/00 383/123 |
| 2015/0274393 | A1 * | 10/2015 | Pilzecker | B65D 31/02 383/211 |

FOREIGN PATENT DOCUMENTS

| | | | |
|---|---|---|---|
| DE | 3629852 | A | 3/1988 |
| DE | 3721303 | A | 1/1989 |
| FR | 2876679 | A | 4/2006 |
| GB | 582327 | B | 11/1946 |

* cited by examiner

SIDE-GUSSET BAG MADE OF A PLASTIC FABRIC COMPOSITE, AND METHOD FOR THE PRODUCTION THEREOF

CROSS REFERENCE TO RELATED APPLICATIONS

This application is the US-national stage of PCT application PCT/EP2013/052899 filed 13 Feb. 2013 and claiming the priority of German patent application 102012101932.0 itself filed 7 Mar. 2012.

FIELD OF THE INVENTION

The present invention relates to a method of making a gusset bag made of a plastic/fabric laminate and a corresponding flat gusset bag. The flat side-gusset bag is cut from a gusseted tube and typically closed only at one of its two ends in order to be filled and ultimately completely closed at the other end. The filled side-gusset bag is provided as a package, in particular, for free-flowing bulk materials such as pelletized animal feed, litter for animals, or similar materials. Due to the use of the plastic/fabric laminate, the side-gusset bag is especially suitable for large bags that have a significant fill volume and a significant filling weight. In practice, corresponding side-gusset bags are also described as side-gusset sacks, although these terms will not be differentiated in the present invention.

The present invention relates to side-gusset bags made of a plastic/fabric laminate that has opposite front and back panels when flat, gussets between them and longitudinal-edge folds between the front and back panels and the gussets. The plastic/fabric laminate comprises a plastic fabric and at least one closed plastic layer with the plastic fabric normally on the inside of the packaging bag.

Even though the plastic fabric typically consists of a material that can be thermally welded, a tight seal is not possible as a result of the fabric structure or at best, with limitations. Unlike typical plastic bags, it is therefore not possible or practical to close the side-gusset bag produced from a plastic/fabric laminate continuous web on its periphery, that is at both edges where the inner surface formed by the plastic fabric is welded with itself. Rather, in side-gusset bags made of a plastic fabric, a gusseted tube is shaped such that edge strips of the continuous web overlap, with a first face of the continuous web at the respective outer edge strip being connected with the inner edge strip of a second face by an adhesive in order to peripherally close the gusseted tube.

A generic flat side-gusset bag is known from EP 1 899 235 [US 2006/029173] and DE 101 06 289 [U.S. Pat. No. 6,800,051]. The gussets extend over a maximum of one third of the width of the front and back panels, i.e. over a maximum of one third of the width of the flat side-gusset bag. In making such a side-gusset bag, a continuous web is first shaped into a gusseted tube with the edges of the continuous web overlapping in the region between the gussets and there, after forming the gusseted tube, they are fixed together with an adhesive. For the adhesive, conventional adhesives can be used such as adhesives containing solvent or hot-melt adhesives. However, within the scope of the invention, an application of a fusible polymer is also suitable as an adhesive, having the effect of a bonding upon the application of force to the overlap.

In known embodiments, in order to first form the gusseted tube and to subsequently be able to peripherally close it, the overlap is always located approximately in the center on one of the front and back panels between the two gussets. Because of the resultant poor appearance, this panel typically forms the back of the side-gusset bag. In spite of that, the overlap extending on the back approximately in the middle can be found to be objectionable, particularly when printed matter is to be located there as well. Finally, in known side-gusset bags made of a plastic/fabric laminate, the design possibilities are significantly limited.

OBJECT OF THE INVENTION

Given this background, the object of invention is to provide a method of making a side-gusset bag and a side-gusset bag in which the disadvantages that have been described above are avoided.

SUMMARY OF THE INVENTION

The subject matter of the invention and the solution of the problem consist of a method of making a side-gusset bag of a plastic/fabric laminate in which a continuous web with a plastic fabric is applied to at least one closed plastic layer and shaped into a tube such that edge strips of the continuous web overlap and a first face of the continuous web form the inner surface and the second continuous web forms the outer surface. At the overlap, the first face of the continuous web at the respective outer edge strip is fixed with the inner edge strip of the second face by an adhesive in order to peripherally close the tube. As adhesives, conventional adhesives are suitable such as solvent-containing adhesives or hot-melt adhesives. Furthermore, a fusible plastic can also be provided as adhesive. Within the scope of the invention, the term adhesive thus includes conventional adhesives, but is not limited to them.

According to the invention, first a simple tube is formed. In flat condition, this simple tube is formed out of two layers of the continuous web at least outside of the overlap.

According to the invention, the tube is first closed and subsequently fed into a folder that shapes it into a flat gusseted tube with opposite front and back panels having gussets inserted between them and edge folds between the front and back panels and the gussets, so that the gusseted tube, at least outside the overlap, has four layers at the gussets and two layers of the continuous web between the gussets.

According to the invention, because of the connection at the overlap, first a closed tube is formed and only then is a flat gusseted tube formed, so the overlap can be freely positioned to a large extent. Thus, the overlap is located at least partly in a section of the gusseted tube that is formed by four layers of continuous web. The overlap is thus either on one of the gussets or on a front panel over one of the gussets.

However, advantageously, it should be avoided that the overlap extends beyond one of the longitudinal-edge folds. But the overlap can easily be placed directly up to one of the longitudinal-edge folds.

Finally, pieces are cut from the gusseted tube to form individual side-gusset bags. Within the scope of the invention, the separation is typically performed without any prior coiling of the gusseted tube. As a result of the location of the overlap in the area of one of the gussets, coiling is disadvantageous, because coiling would produce a coil with uneven thickness.

Preferably, the continuous web is formed by laminating the plastic fabric with a film so that the plastic fabric forms the first face, and the film forms the second face of the continuous web. Within the scope of such an embodiment, lamination with adhesive or preferably an extrusion lamination is possible where a fusible polymer film is inserted between the film and the plastic fabric. Such a polymer film can have one layer or several layers. When inserting a multilayer film, it is created by coextrusion, as a result of which an optimal bonding with the plastic fabric can be achieved on the one hand, and also with the outer film on the other hand.

Lamination also provides the advantage that the outer films of the side-gusset bag can be provided with printed matter even prior to lamination. This printed matter is then advantageously located on the side that is laminated with the plastic fabric. In the plastic/fabric laminate formed in this way, the printed matter is then positioned in a way that is protected on an inner face.

In place of laminating with a film, the plastic fabric can also be coated with a fusible plastic layer to form the plastic/fabric laminate. Even in such an embodiment, the plastic fabric can provide a high degree of stability, while the plastic layer that is applied has the effect of a tight closure and forms a largely homogeneous, printable outer surface. However, within the scope of such an embodiment there is the disadvantage that the plastic coating formed in this way can only be provided with an printed matter on an outer face. But if necessary, such printed matter can also be provided with a protective lacquer to achieve a high degree of resistance against abrasion.

Beyond that, the protective lacquer can also be provided for achieving a flat, nonslip surface. A flat, nonslip surface is preferred in order to avoid shifting while stacking the filled side-gusset bags. For the same reason, when laminating with a film as the outer layer, preferably a flat polymer material that has a nonslip surface consistency is provided for the outer layer.

At the overlap, the outer edge of the continuous web is visible at the outer edge strip. The overlap is therefore advantageously formed such that the outer edge of the continuous web is on that side of the overlap adjacent the closest edge fold. In such an embodiment, the outer edge of the continuous web can be placed directly up to the closest edge fold.

Preferably, the spacing from the outer edge to the closest edge fold is less than 80 mm.

Within the scope of an alternate embodiment of the invention it is also possible to locate the overlap on one of the gussets. Both the front and the back panel are then free of any impediment and can be provided with printed matter on their entire surface.

Advantageously, the plastic fabric is formed by strips or ribbons of a stretched film, with a first group of ribbons and a second group of ribbons extending perpendicular to one another. It is known to produce corresponding plastic fabrics on circular knitting machines. The width of the ribbons crossing each other is typically between 2 mm and 4 mm, in particular, between 2.5 mm and 3.2 mm. The plastic ribbons that are longitudinally stretched are typically produced made of polyolefin, in particular, polypropylene. For the side-gusset bag according to the invention, in particular, plastic fabrics with a weight per unit of area between 50 g/m$^2$ and 100 g/m$^2$, are suitable, for example, with a weight by unit of area of approximately 72 g/m$^2$.

Even though polyolefins and, in particular, polypropylene are generally thermoplastic, the plastic fabric cannot easily be thermally welded because of its fabric structure. In order to be able to provide functional elements such as reclosable seals or the like at the inner side of the side-gusset bag, the plastic fabric can optionally also be provided with a hot-seal coating in sections or over its entire surface, or be provided with glued-on hot-sealable film patches.

The side-gusset bag according to the invention is particularly well-suited for a large fill volume and a heavy weight. Given this background, it can be advantageous to provide the side-gusset bag with a carry handle. Because of the difficult of welding to the inner plastic fabric, a carry handle that is glued onto the outer surface of the side-gusset bag must be considered. As has already been explained, the inner face can be provided with individual hot-sealable film patches at which a carrying handle can then also be fastened.

According to a preferred embodiment of the invention the side-gusset bag consists entirely of polyolefin and especially preferred, entirely out of polypropylene (PP). Within the scope of such an embodiment, the side-gusset bag can be recycled easily or incinerated with no ash.

In a plastic/fabric laminate formed by extrusion lamination, the film located on the outside of the side-gusset bag can consist of, for example, polypropylene, in particular, a biaxially oriented polypropylene (BO-PP). The layer thickness of such a film is preferably between 10 and 40 μm, especially preferred between 15 and 30 μm.

In extrusion lamination, a fusible film is inserted between the outer film and the plastic fabric, and this film must have a sufficient thickness in order to form a secure bond in spite of a structure of the plastic fabric that is irregular to a certain degree. Thus, the film that is provided for the bonding preferably has a weight per unit of area of between 25 g/m$^2$ and 40 g/m$^2$. The fusible film can be extruded in one layer as well as coextruded in multilayers. In a multilayered coextrusion, advantageously, a thin adhesion-promoting layer is provided against the outer film on the side-gusset bags. In principle, the outer film and the plastic fabric can be provided with a primer prior to lamination to increase the bonding strength. Especially in the case of a one-layer extrusion, the application of primer to the film is advantageous if the film is printed. Then, an adequate adhesion of the fusible film must be achieved on the printed matter.

Within the scope of the method according to the invention, first a simple tube is formed that is peripherally closed at an overlap. Preferably, the tube is formed flat with two lateral outer web edges, then the tube is formed into a gusseted tube such that the outer web edges are located at one of the longitudinal-edge folds of the gusseted tube. The finished side-gusset bag then has diagonally opposite longitudinal-edge folds.

The formation of the tube out of the continuous web, the peripheral closing of the continuous web in the overlap and the formation of the gusseted tube preferably takes place on a continuous strand in successive method steps. Within the scope of such an embodiment, mass production is possible, with an advance rate of the strand equal, for example, to at least 70 m/min, preferably 100 m/min (meters per minute).

The length of the individual tube pieces cut from the gusseted tube preferably ranges between 700 mm and 1200 mm. By taking the previously cited advance rate into consideration, this results in a typical production-cycle rate of approximately 100 tube pieces and thus 100 side-gusset bags per minute.

The separated tube pieces are first open at their two ends. But advantageously, the tube pieces will be closed at one of their ends directly after separation. Thus, one of the open ends of the tubular pieces can be rolled in and fixed together in rolled-in condition. When rolling in, based on the open end, typically a first strip of the tubular piece is folded by 180° and then a second strip having the first strip located on it is also folded in by 180°. The strips can, for example, have a width of approximately 20 mm. The fixation can, for example, be accomplished by an adhesive strip, by an adhesive or by hot air. When the end that is closed in this way forms the bottom of the side-gusset bag, the side-gusset bag is subsequently filled in a filling system at its upper end and then closed at its upper end. As is the case in typical paper sacks, closure can be accomplished, for example, by sewing or welding together.

According to an alternative design, the end of the side-gusset bag that is directly closed during production is intended to be the upper edge of the side-gusset bag. The rolled-in end can thereby be fixed together by an adhesive strip that can be pulled off again. As a result of the adhesive strip that can be pulled off, an especially easy opening of the filled side-gusset bag can be achieved. Within the scope of such an embodiment, the bag that is prepared in this way can then be filled from the lower end and closed there. In particular, it is also known to provide an adhesive strip in the center that can then be pulled off laterally in both directions.

For practical reasons, the rolling in for flat tubular pieces is typically done on that edge at which the overlap is also provided. According to the prior art, the front panel with the clearly visible overlap and the rolled-in end is typically located on the back of the bag. An adhesive strip that can be pulled off is then, however, not directly noticeable by the user. Within the scope of the present invention, the advantage results that the overlap is located far toward the outer edge at one of the gussets and in this way, the visual appearance is less disturbing. The corresponding front panel of the side-gusset bag can therefore also be provided as the front so that then a removable adhesive strip on a rolled-in end is likewise on the front side and is visible directly.

The weight per unit of area of the plastic/fabric laminate is preferably between 100 g/m$^2$ and 150 g/m$^2$.

BRIEF DESCRIPTION OF THE DRAWING

In the following, the invention will be explained in more detail reference to a drawing showing only one embodiment. Therein.

SPECIFIC DESCRIPTION OF THE INVENTION

Figure 1:
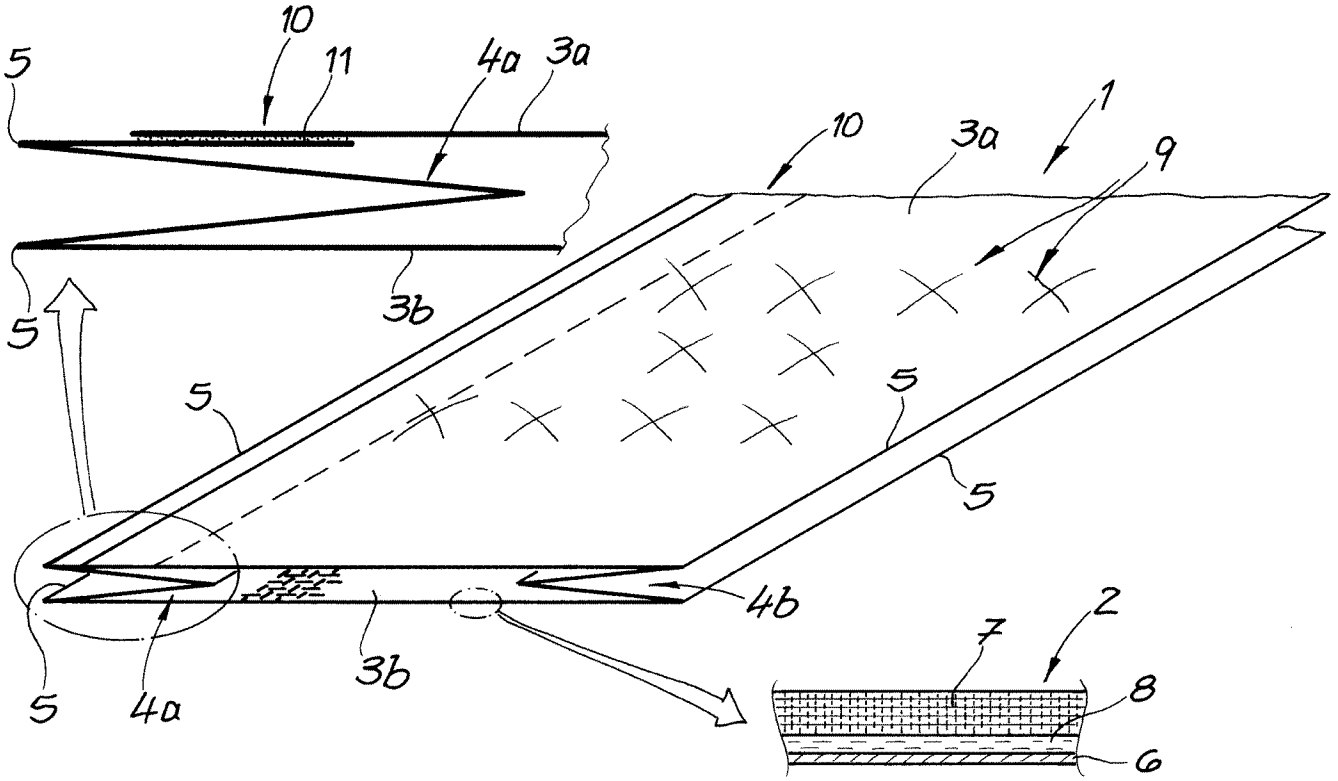
FIG. 1 is a perspective sectional view of a gusseted tube.
Figure 2:
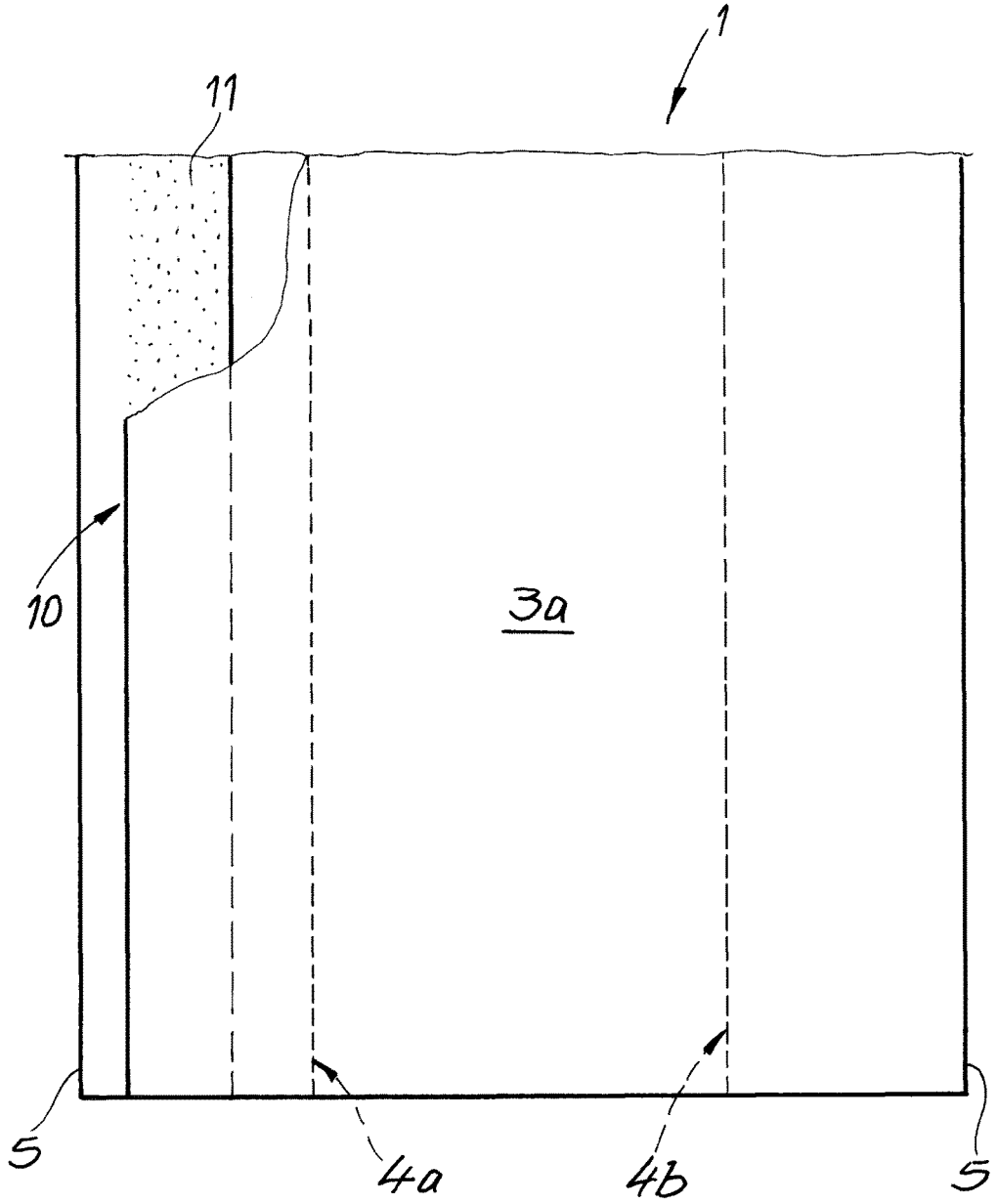
FIG. 2 is a top view of a gusseted tube according to FIG. 1.

FIG. 1 shows a gusseted tube 1 made of plastic/fabric laminate 2, from which individual flat side-gusset bags can be cut. The gusseted tube 1 or the individual side-gusset bags have opposite front and back panels 3*a* and 3*b* with gussets 4*a* and 4*b* inserted between them, as well as longitudinal-edge folds 5 between the front and back panels 3*a* and 3*b* and the gussets 4*a* and 4*b*.

According to the enlarged sectional view of FIG. 1, the plastic/fabric laminate 2 is formed by extrusion lamination of a film 6 forming the outer surface of the gusseted tube 1 and a plastic fabric 7 that lies on the inner surface of the gusseted tube 1. The film 6 and the plastic fabric 7 are connected by an intermediate layer 8 inserted as a fusible film during the extrusion lamination. According to FIG. 1, the plastic fabric 7 is formed by film strips crossing each other and typically having a width of approximately 3 mm.

The weight by unit of area of the plastic fabric 7 is 72 g/m$^2$, and the strips consist of polypropylene and are axially stretched. Typically, the strips are arrayed with a first group of strips extending longitudinally of the gusseted tube 1 and a crossing second group of strips extending transversely. Since the stretched strips crossing each other, a particularly high degree of stability of the side-gusset bag is achieved. In particular, local damage such as punctures, cracks or the like cannot expand in the plastic/fabric laminate 2.

The film 6 that on the outside of the gusseted tube 1 can, for example, consist of a biaxially oriented polypropylene (BO-PP) having a typical thickness of 18 μm. Preferably, a comparable nonslip material is used to avoided shifting while stacking the filled side-gusset bags 15. The fusible intermediate layer 8 in the laminate also consists of polypropylene, so that the entire the plastic/fabric laminate 2 consists of polypropylene and can thus be easily recycled. The weight per unit of area of the intermediate layer 8 is, for example, 30 g/m$^2$.

FIG. 1 further shows that the film 6 is printed on its outer face adjacent to intermediate layer 8. This gives the advantage that this printed matter 9 is optimally protected against any external influences because of its location inside the laminate.

Overall, the plastic fabric 7 cannot be welded well, for which reason for the purpose of closing the gusseted tube 1, an overlap 10 is provided at which edge strips of the plastic/fabric laminate 2 overlie each other. At the overlap 10, the outer face of an edge strip of the plastic fabric 7 engages an inner face of an opposite edge strip of the film 6 to close the gusseted tube 1. Not only conventional adhesives such as solvent-containing adhesives and hot-melt adhesives come into consideration as an adhesive 11, but also fusible plastics. Within the scope of the present invention, an application of fusible polypropylene is particularly preferred.

According to the invention, the overlap 10 is located on a gusset 4*a* and 4*b*, or off-center on one of the front and back panels 3*a* and 3*b*, at least partly over one of the gussets 4*a* and 4*b*. For this reason, it is not easy to first form the gusseted tube 1 and then make the bond with the adhesive 11 in the overlap 10.

Figure 4A:
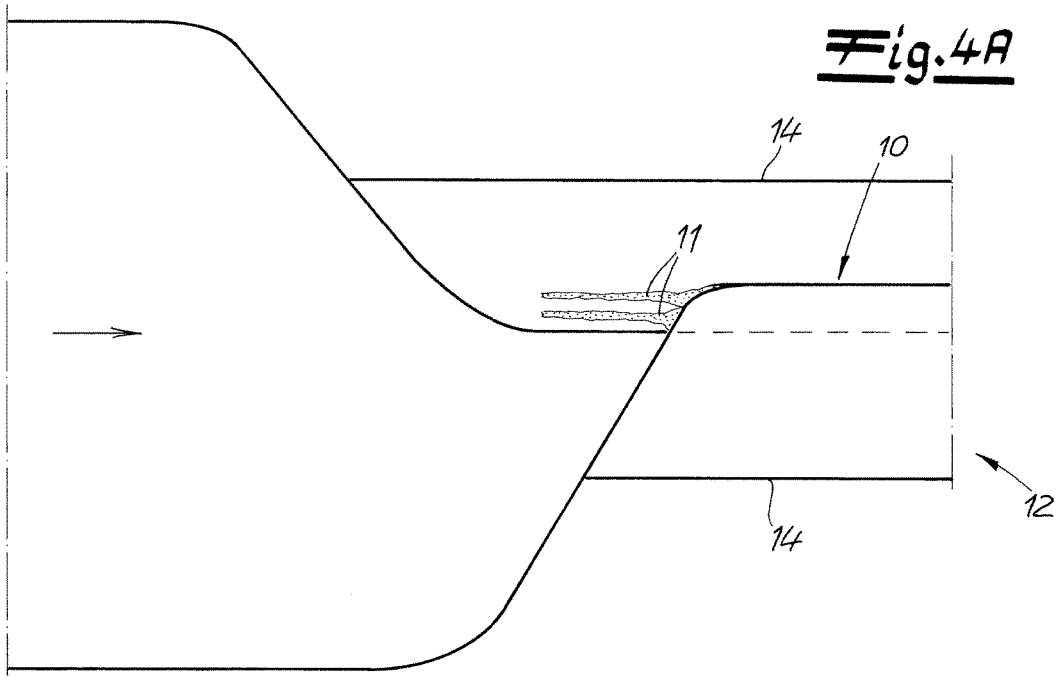
FIGS. 4*a* and 4*b* are schematic views showing the method steps for making the gusseted tube according to FIG. 1.

According to the invention, in the method of making a side-gusset bag according to FIG. 4*a* out of the plastic/fabric laminate 2 that is extends as a continuous web, a simple, flat tube 12 is formed that is closed at the overlap 10 by adhesive 11.

Figure 4B:
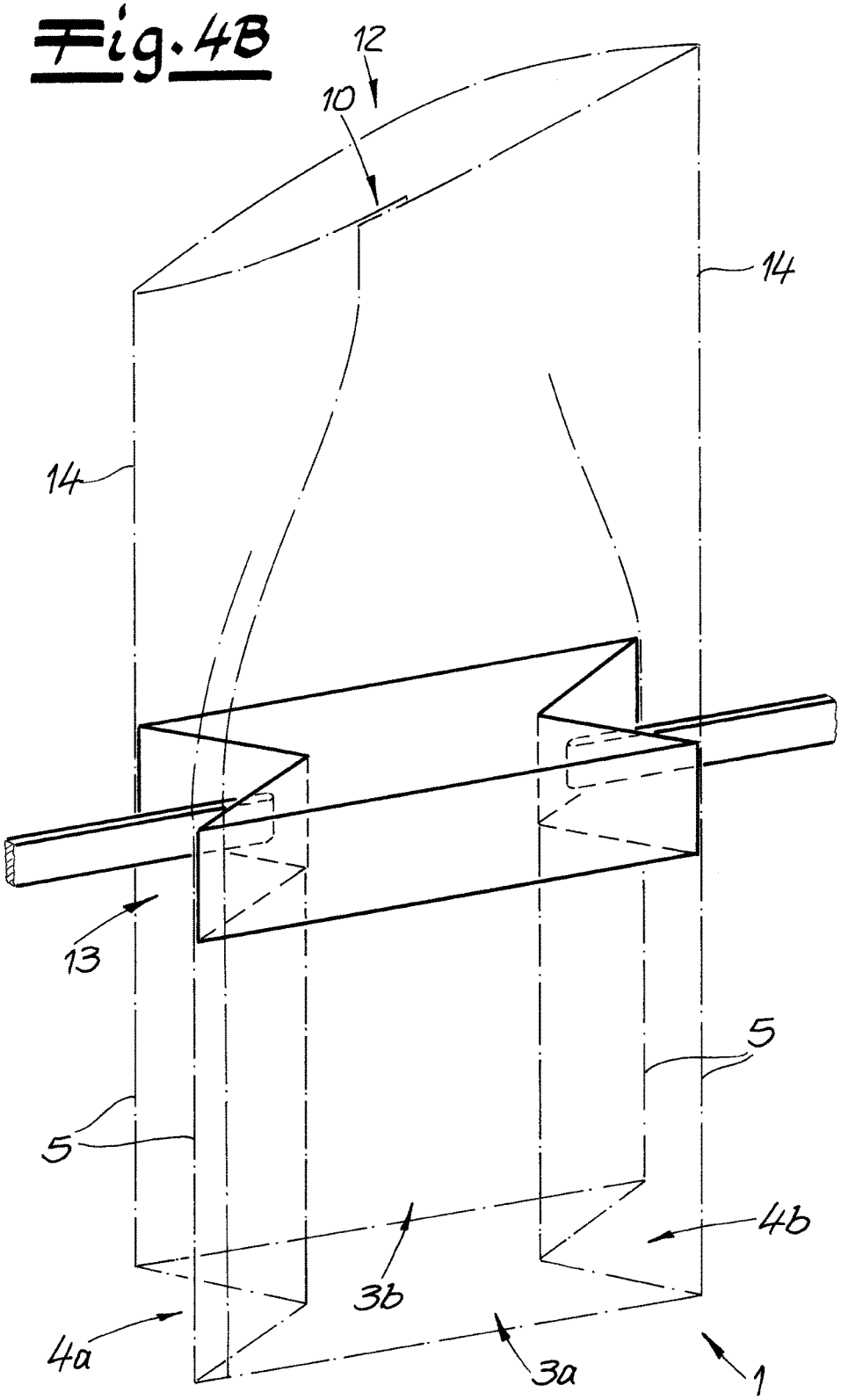

As shown in FIG. 4*b*, the closed tube 12 is subsequently fed into a folder 13 that shapes the previously described flat tube into the flat gusseted tube 1. The flat tube 12 is advantageously fed into the folder 13 such that two of the longitudinally extending edge folds 5 are formed at each of the two outer edges 14 of the flat tube 12.

Since according to the invention the gussets 4*a* and 4*b* are made only after making the closed flat tube 12, the overlap 10 can also easily be formed in a section of one of the gussets 4*a* and 4*b*, i.e. on one of the gussets 4*a* and 4*b*, or on one of the front and back panels 3*a* and 3*b* at least partly over one of the gussets 4*a* and 4*b*.

The formation of the flat tube 12 from the plastic/fabric laminate 2 as a continuous web, the closing of the continuous web at the overlap 10, as well as the formation of the gusseted tube 1 take place continuously as a continuously running strand that is preferably advanced at a rate of at least 70 m/min (meters per minute).

To be able to form individual side-gusset bags, individual tubular pieces are cut from the gusseted tube 1, typically having a length of between 700 mm and 1200 mm.

In order to close one end of the tubular pieces, the end can be rolled in by a method that is known per se and can be fixed in the rolled-in position. An end that is closed in this way can form the lower edge as well as also the upper edge of the side-gusset bag.

Figure 3:
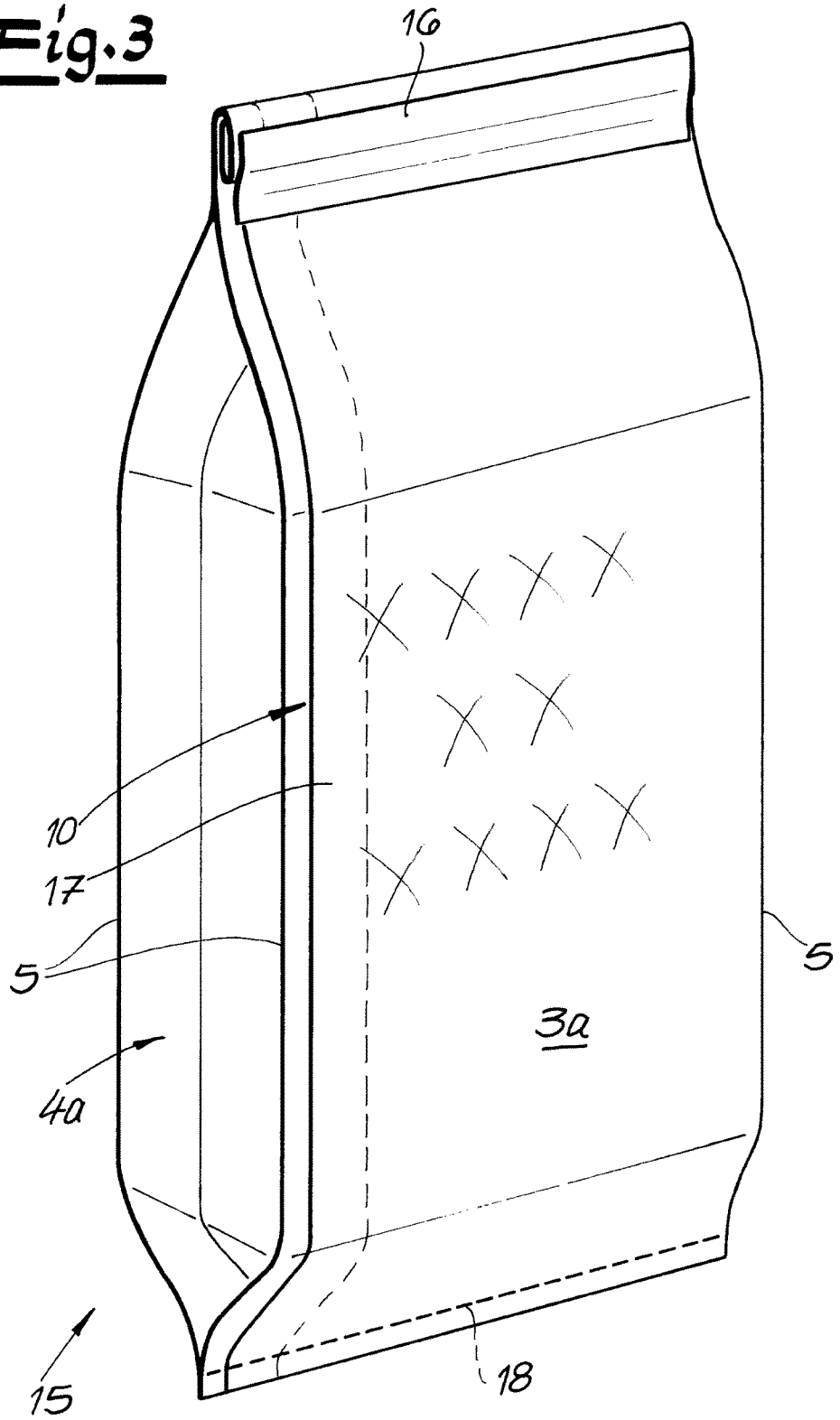
FIG. 3 is a view like FIG. 1 showing a side-gusset bag formed of the tube of FIG. 1.

FIG. 3 shows a possible embodiment of a filled side-gusset bag 15 in which one end is rolled in onto itself by double folding and is fixed in this rolled-in condition by an adhesive strip 16.

The adhesive strip 16 can be pulled off so that the filled side-gusset bag 15 can be opened easily. Furthermore, the outer edge 17 of the plastic/fabric laminate 2 visible at the overlap 10 is set at a small spacing to one of the longitudinal edges 5. For this reason, the overlap 10 can also be on the front of the filled side-gusset bag 15 where the adhesive strip 16 is also provided. The visual appearance of the printed front side of the filled side-gusset bag 15 is not significantly impaired by the overlap 10 set at the edge.

The side-gusset bag 15 shown in FIG. 3 was filled from its bottom side and was closed there, for example, by a stitched seam as is typical for sacks made of paper or cloth.

The invention claimed is:

1. A method of making a side-gusset bag from a plastic/fabric laminate, the method comprising the steps of:

providing a longitudinally extending and continuous web having opposite first and second faces and made of a plastic fabric forming one of the faces and at least one closed plastic layer forming the other of the faces;

shaping the continuous web into a continuous tube such that longitudinal edge strips of the continuous web overlap and that the first face of the continuous web forms an inner surface and the second face of the continuous web forms an outer surface of the tube and the inner surface confronts the outer surface at the overlap;

inserting an adhesive at the overlap between the confronting inner and outer surfaces and thereby bonding at the overlap the inner surface of the tube with the outer surface of the tube to peripherally close the tube;

flattening the closed tube with the edge strips bonded at the overlap by the adhesive between the inner and outer surfaces of the tube such that the flattened tube has two longitudinally extending outer edges;

feeding the flattened closed tube into a folder that shapes it into a flat gusseted tube with opposite front and back panels having gussets at longitudinal-edge folds formed by the longitudinally extending outer edges between the front and back panels so that the gusseted tube has longitudinal edge regions formed by four layers of the continuous web at the gussets and two layers between the gussets;

forming the gusseted tube such that the overlap is at least partly in one of the longitudinal edge regions of the gusseted tube formed by four layers of the continuous web; and cutting tubular pieces from the gusseted tube to form individual side-gusset bags.

2. The method defined in claim 1, wherein the continuous web is formed by laminating the plastic fabric with a film forming the closed plastic layer such that the plastic fabric forms the first face and the film forms the second face of the continuous web.

3. The method defined in claim 2, wherein the film and the plastic fabric are laminated together by coextrusion.

4. The method defined in claim 2, further comprising the step of:

providing the film with printed matter lamination with the plastic fabric on its printed face.

5. The method defined in claim 4, further comprising the step of:

covering the printed matter by the at least one transparent outer layer of the plastic/fabric laminate.

6. The method defined in claim 1, further comprising the step of:

rolling in an open end of the tubular pieces and fixing the open end together in rolled-in condition.

7. The method defined in claim 5, further comprising the step of:

fixing together the rolled-in end by a removable adhesive strip.

8. The method defined in claim 1, wherein the overlap is formed on one of the front and back panels such that an outer edge of the continuous web that forms one of the outer edge strips is spaced by less than 80 mm to the closest edge fold.

9. The method defined in claim 1, wherein the overlap is on one of the gussets.

10. The method defined in claim 1, wherein the side-gusset bag consists entirely of olefin.

11. The method defined in claim 1, wherein the formation of the closed tube out of the continuous web, the closing of the continuous web at the overlap, and the formation of the gusseted tube take place while continuously displacing the web.

12. The method defined in claim 10, wherein the web is advanced at at least 70 m/min.

13. The method defined in claim 1, further comprising the step of:

cutting tubular pieces having at least a length ranging between 700 mm and 1200 mm from the gusseted tube.

14. The method defined in claim 1, wherein the plastic/fabric laminate has a weight by unit of area of between 100 $g/m^2$ and 150 $g/m^2$.

15. The method defined in claim 1, further comprising the step of:

forming the plastic fabric from strips with a strip width of between 2 mm and 4 mm.

* * * * *